US005331816A

United States Patent [19]

Able et al.

[11] Patent Number: 5,331,816

[45] Date of Patent: Jul. 26, 1994

[54] GAS TURBINE ENGINE COMBUSTOR FIBER REINFORCED GLASS CERAMIC MATRIX LINER WITH EMBEDDED REFRACTORY CERAMIC TILES

[75] Inventors: Edward C. Able, Tolland; Martin J. Gibler, Manchester, both of Conn.

[73] Assignee: United Technologies Corporation, Hartford, Conn.

[21] Appl. No.: 960,158

[22] Filed: Oct. 13, 1992

[51] Int. Cl.[5] ..... F23R 3/00

[52] U.S. Cl. ..... 60/753; 60/752

[58] Field of Search ..... 60/752, 753, 755, 39.32, 60/757; 110/339, 340

[56] References Cited

U.S. PATENT DOCUMENTS

| | | | |
|---|---|---|---|
| 2,919,549 | 2/1960 | Haworth et al. | 60/39.65 |
| 3,534,131 | 10/1970 | Gebler et al. | 264/59 |
| 3,891,735 | 6/1975 | North | 264/59 |
| 3,956,886 | 5/1976 | Sedgwick | 60/39.69 |
| 4,441,324 | 4/1984 | Abe et al. | 60/753 |
| 4,512,159 | 4/1985 | Memmen | 60/752 |
| 4,738,902 | 4/1988 | Prewo et al. | 428/697 |
| 4,749,029 | 7/1988 | Becker et al. | 165/47 |
| 4,848,089 | 7/1989 | Cramer | 60/752 |
| 5,113,660 | 5/1992 | Able et al. | 60/752 |

FOREIGN PATENT DOCUMENTS

| | | | |
|---|---|---|---|
| 1487064 | 9/1977 | United Kingdom | 60/753 |

*Primary Examiner*—Richard A. Bertsch
*Assistant Examiner*—Timothy S. Thorpe
*Attorney, Agent, or Firm*—Charles E. Sohl

[57] ABSTRACT

A gas turbine engine combustor liner with improved high temperature capability is achieved by embedding ceramic tiles into a fiber reinforced glass ceramic matrix composite substrate, so as to incorporate a space between the tiles and the substrate, the space serving to eliminate a direct heat conductive path between the tile and the substrate. The space is created by inserting a fugitive layer between the tiles and the substrate prior to compaction of the substrate, followed by removal of the fugitive layer. A fugitive material sprayed on the supportive region of the tiles prior to liner fabrication prevents the substrate material from bonding to the tiles, and prevents cracking of the tiles during temperature cycling.

8 Claims, 2 Drawing Sheets

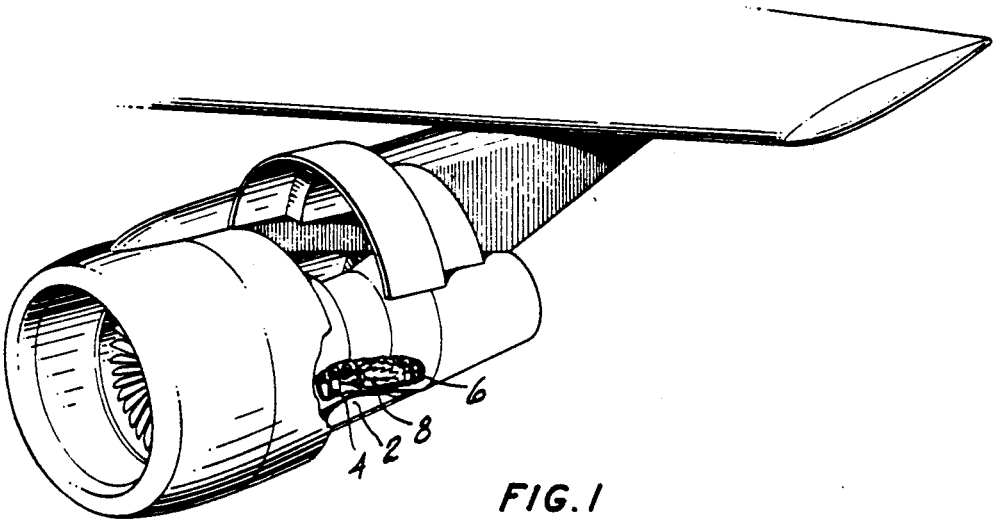
FIG. 1
FIG. 2
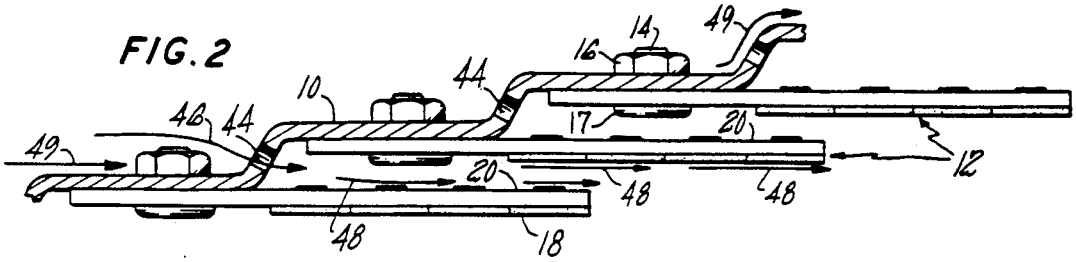
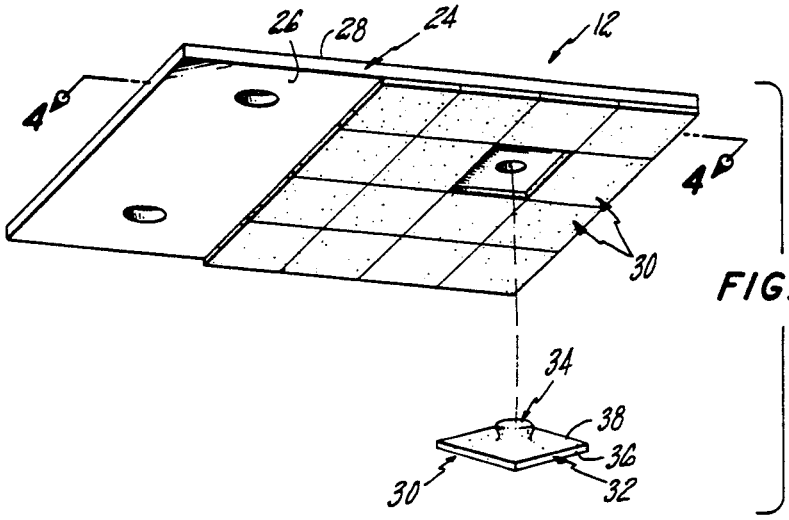
FIG. 3

GAS TURBINE ENGINE COMBUSTOR FIBER REINFORCED GLASS CERAMIC MATRIX LINER WITH EMBEDDED REFRACTORY CERAMIC TILES

TECHNICAL FIELD

This invention relates to a high-temperature combustor liner for gas turbine engines, and more particularly to a combustor liner lined with temperature-resistant ceramic tiles. The invention also relates to a method of fabrication of the combustor liners.

BACKGROUND ART

The combustor of a gas turbine engine is exposed to local gas temperatures which commonly approach 3,500° F. Rapid and wide ranging thermal excursions during heat up and cool down of the engine result in the cyclic exposure of combustor components to thermal shock and to high thermal stresses. At operating temperature, the combustor liner must support a steep thermal gradient across the liner from the hot inner surface to the cooler outer surface. Although the combustor does not experience a high mechanical load, the large thermal distortion of the components under operating conditions requires that the combustor exhibit elevated temperature load-carrying ability. In addition, the combustor is subjected to hot corrosive gases which chemically attack and mechanically erode the combustor wall.

The continually higher temperatures experienced in advanced gas turbine engines have carried combustor material requirements to the point at which even new and exotic metal alloys cannot effectively and economically provide the performance requirements and lifetimes required. The highest performance combustor liners are limited to a surface temperature of about 2,200° F., so that the metal alloy combustor liners must be cooled by passing large quantities of cooling air over the inner and outer surfaces of the liners to ensure that the combustor wall temperature does not exceed the capabilities of the metal alloy. To operate at higher temperatures would require more cooling air to be diverted from the engine airflow, with a consequent degradation in engine performance, turbine durability, and increased engine emissions.

Ceramic materials are attractive materials for high temperature applications due to their characteristic high thermal stability. In the co-pending U.S. patent application Ser. No. 07/136,307, of common assignee herewith (currently under a U.S.P.T.O. Secrecy Order), ceramic tiles mounted to a fiber-reinforced substrate are used as panels to line the inside wall of the combustor. The ceramic tiles are embedded in the substrate support panel prior to firing the substrate, with the tiles and the substrate being in intimate contact with each other during the fabrication and firing processes. While this provides an improved combustor with significantly increased operating temperature capability, the contact between the tiles and the substrate provides a direct path for heat transfer from the tiles to the substrate.

What is needed is a combustor liner fabricated so as to minimize the direct contact between the tiles and the substrate so that the direct conduction of heat from the tiles to the substrate is reduced. This would permit the combustor to operate at higher temperatures without increasing the cooling air requirements, thus improving the performance of the engine.

DISCLOSURE OF THE INVENTION

The present invention provides a combustor liner for a gas turbine engine which includes an array of overlapping fiber reinforced composite substrate panels, each having an array of refractory ceramic tiles substantially covering the surface of the substrate panels to thermally insulate the substrate panels from the heat generated in the combustion process. The improvement of this invention over prior art combustor liners lies in providing an air gap between the tiles and the substrate in order to provide increased protection for the substrate panels.

The method of creating the air gap disclosed in the present invention is to interpose a fugitive layer between the ceramic tiles and the substrate during buildup of the substrate panel assembly, with the fugitive layer then being removed after firing of the assembly by heating the fired assembly in an oxidizing atmosphere.

These, and other features and advantages of the invention, will be apparent from the description below, read in conjunction with the drawings.

BRIEF DESCRIPTION OF DRAWINGS

FIG. 1 shows a perspective view of a gas turbine engine, partially broken away to show a portion of the combustor.

FIG. 2 shows a cross section of a portion of a combustor liner wall.

FIG. 3 shows a partially exploded perspective view of a combustor liner panel.

BEST MODE FOR CARRYING OUT THE INVENTION

Figure 4:
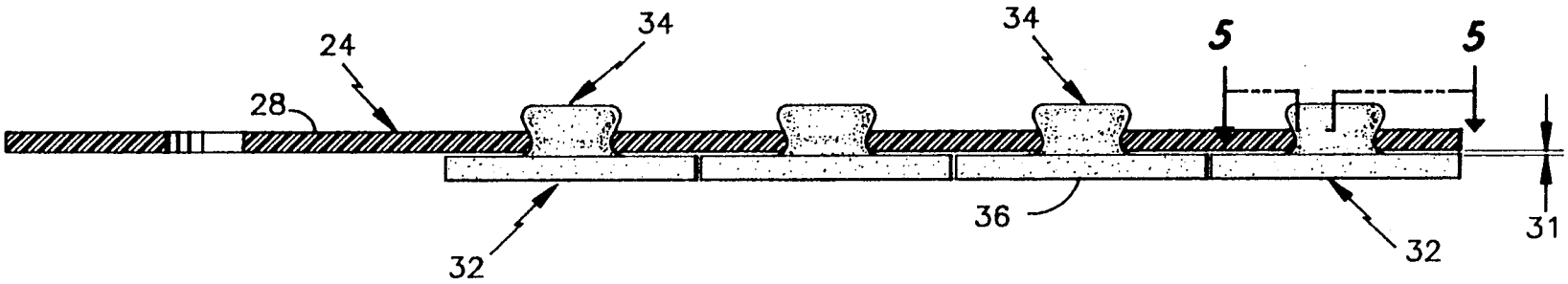
FIG. 4 shows a cross section across the line 4—4 of FIG. 3.

FIG. 1 shows a perspective view of a gas turbine engine, partially broken away to show a portion of the combustor 2. The combustor includes an intake end 4 and an exhaust end 6. A fuel mixture introduced at the intake end 4 and undergoes combustion within the combustor 2 to produce a stream of exhaust gas. The exhaust gas exits the exhaust end 6. The inner surface of the combustor 2 is lined with a temperature resistant combustor liner 8.

FIG. 2 shows a cross section of an upper portion of the combustor liner 8. The combustor liner 8 includes a metallic shell 10 and an array of axially overlapping combustor liner panels 12 disposed to provide line-of-sight coverage for the inner surface of the metallic shell 10. The panels 12 are attached to the metallic shell 10 with bolts 14 and nuts 16. Each of the bolts 14 is positioned such that the bolt head 17 is protected from heat from the combustion gas by a combustor liner panel 12 disposed immediately upstream.

One skilled in the art will understand that the concepts disclosed herein are also applicable to a tiled combustor shell wherein the tiles are imbedded directly into the shell rather than being mounted on panels which are then mounted on the shell.

Each of the combustor liner panels 12 includes an inner surface 18 which is exposed to the high temperature combustion gases, and an outer surface 20. The combustor liner panels 12 form a thermal barrier to protect the metallic shell 10 from the hot combustion gases.

FIG. 3 shows a perspective view of a typical combustor liner panel 12. The combustor liner panel 12 includes a fiber reinforced composite substrate 24 which has an inner surface 26 and an outer surface 28, an array of refractory ceramic tiles 30 embedded in the substrate 24 and substantially covering a large portion of the inner surface 26, and a space between the tiles 30 and the substrate 24. The space is too small to be shown in FIG. 3, but is shown in FIG. 4 and indicated by the reference numeral 31. The space can range from 0.001–0.030"; the preferred spacing is typically 0.005–0.008".

A tile 30 is shown in the exploded portion of FIG. 3. The tile includes a protective region 32 and a supportive region 34. The protective region 32 includes an inner surface 36 for orienting toward the interior of the combustion chamber and an opposite outer surface 38. The supportive region 34 extends from the outer surface 38 in a direction perpendicular to the outer surface 38 and is conically shaped with a cone angle of 25±2°.

Referring again to FIG. 2, the metallic shell 10 includes cooling air ports 44. A stream of cooling air 46 is introduced through each of the cooling air ports 44 during operation of the engine and flows across the outer surface 20 of the combustor liner panel 12 and across the inner surface 36 of the tiles 30, as shown by the arrows 48. Cooling air also flows over the outer surface of the metallic shell 10, as shown by the arrows 49.

FIG. 4 shows a cross section along the line 4—4 in FIG. 3. The protective region 32 of each tile covers a portion of the inner surface 26 of the substrate. The supportive region 34 of each tile 30 is embedded in the fiber reinforced glass matrix composite substrate 24 and the supportive region 34 of each tile 30 extends slightly beyond the outer surface 28 of the substrate 24 to secure the tile 30 to the substrate 24. The supportive region 34 is long enough to accommodate the gap 31, and shaped such that the supportive region 34 controls the gap 31 spacing (shown exaggerated for purposes of illustration) by the manner in which the supportive region 34 is surrounded by the substrate 24. As described below, the substrate 24 is fabricated so as to prevent bonding of the substrate 24 to the supportive region 34.

Figure 5:
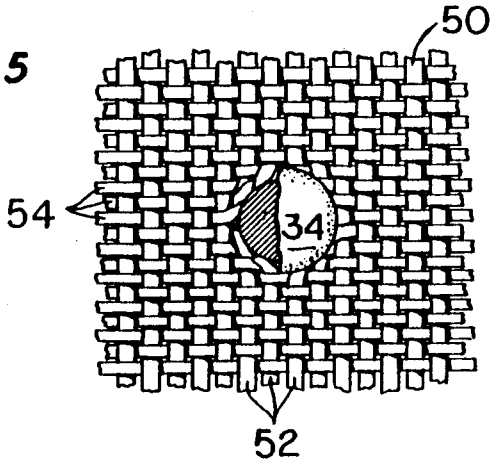
FIG. 5 shows a cross section across the line 5—5 of FIG. 4.

FIG. 5 shows a cross section across the line 5—5 of FIG. 4. A cross section of the stem 40 is shown embedded in the plies of woven fibers 50 between the continuous warp fibers 52 and the continuous woof fibers 54 of the woven fiber reinforced glass matrix composite substrate 24.

The matrix of the present invention may comprise any glass or glass ceramic material that exhibits resistance to elevated temperature and is thermally and chemically compatible with the fiber reinforcement of the present invention. The term "glass-ceramic" is used herein to denote materials which may, depending on processing parameters, comprise only a glassy phase or may comprise both a glassy phase and a ceramic phase. By resistance to elevated temperature is meant that a material does not substantially degrade within the temperature range of interest and that the material retains a high proportion of its room temperature physical properties within the temperature range of interest. A glass matrix material is regarded as chemically compatible with the fiber reinforcement if it does not react to substantially degrade the fiber reinforcement during processing. A glass matrix material is regarded herein as thermally compatible with the fiber reinforcement if the coefficient of thermal expansion (CTE) of the glass matrix and the CTE of the fiber reinforcement are sufficiently similar that differential thermal expansion of the fiber reinforcement and the matrix during thermal cycling does not result in delamination of the fiber reinforced glass matrix composite substrate of the present invention. Borosilicate glass (e.g. Corning Glass Works (CGW) 7740), aluminosilicate glass (e.g. CGW 1723) and high silica glass (e.g. CGW 7930) as well as mixtures of glass are examples of suitable glass matrix materials.

Suitable matrices may also be based on glass-ceramic compositions such as lithium aluminosilicate (LAS), magnesium aluminosilicate (MAS), calcium aluminosilicate (CAS), barium magnesium aluminosilicate (BMAS), barium aluminosilicate (BAS) on combinations of glass-ceramic materials or on combinations of glass materials and glass-ceramic materials.

The choice of a particular matrix material is based on the anticipated demands of the intended application. For applications in which exposure to temperatures greater than about 500° C. is anticipated, lithium aluminosilicate is the preferred matrix material. Preferred lithium aluminosilicate glass ceramic matrix compositions are disclosed in commonly assigned U.S. Pat. Nos. 4,324,843 and 4,485,179, the disclosures of which are incorporated herein by reference.

While glass or glass ceramic matrix materials are preferred, it will be appreciated by those skilled in the art that ceramic matrix materials, such as SiC or $Si_3N_4$ may also be suitable matrix materials for some applications. Ceramic matrices may be fabricated by such conventional processes as chemical vapor infiltration, melt infiltration, directed melt oxidation, sol-gel processes and the pyrolysis of organic precursor materials.

The fiber reinforcement of the present invention may comprise any fiber that exhibits high tensile strength and high tensile modulus at elevated temperatures. Suitable fibers include silicon carbide (SiC) fibers, silicon nitride ($Si_3N_4$) fibers, and refractory metal oxide fibers. Silicon carbide fibers and silicon nitride fibers are preferred. Nicalon TM ceramic grade fiber (Nippon Carbon Co.) is a silicon carbide fiber that has been found to be suitable for use with the present invention. Nicalon TM ceramic grade fiber is available as a multifilament silicon carbide yarn with an average fiber diameter of about 10 microns. The average strength of the fiber is approximately 300,000 psi and the average elastic modulus is approximately $32\times10^6$ psi.

The fiber reinforcement and the glass ceramic matrix of the present invention are combined so as to produce a fiber reinforced glass ceramic matrix composite substrate 24 which exhibits a high load bearing ability at elevated temperatures, high resistance to thermal and mechanical shock, and high resistance to fatigue, as well as being thermally compatible with the refractory ceramic tiles of the present invention. It is preferred that the fiber reinforcement comprise a volume fraction of between about 20% and about 60% of the fiber reinforced glass ceramic matrix composite substrate. It is difficult to obtain a proper distribution of fibers if the volume fraction of fibers is below 20%, and the shear properties of the glass ceramic matrix composite material are greatly reduced if the volume fraction of fiber exceeds about 60%. It is most preferred that the fiber reinforcement comprises a volume fraction between about 35% and about 50% of the fiber reinforced composite substrate.

The refractory ceramic tile 30 of the present invention may comprise any ceramic material which exhibits high flexural strength, oxidation resistance, and thermal shock resistance under the operating conditions of a gas turbine engine combustor, and which has a thermal expansion coefficient in the range that may be matched to the fiber reinforced glass ceramic matrix composite substrate of the present invention. Silicon carbide, silicon nitride, alumina and zirconia are preferred refractory ceramic tile materials. Silicon carbide and silicon nitride are the most preferred refractory ceramic tile materials because their CTE is better matched to the substrate materials, and they have higher thermal shock resistance. Although their thermal conductivity is greater than, e.g., alumina, the improvements embodied in this invention permit their successful use.

The refractory ceramic tile 30 of the present invention may be fabricated by conventional means as, for example, hot pressing, cold pressing, injection molding, slip casting or hot isostatic pressing, provided the fabrication process is carefully controlled to minimize flaw formation and to enhance the reliability of the tiles. It should be noted that fabrication processes influence the physical properties as well as the shape of the tile (e.g. the highest strength typically occurs with hot pressed material, and the lowest with injection molded material). Hot pressed and machined tiles offer the most flexibility for development purposes. Slip casting and injection molding offer greater opportunities for cost reduction in a production environment.

The supportive region 34 of each tile 30 is sprayed with a graphite base mold release material to prevent the substrate 24 from adhering to the tile. Aerodag G TM, available from Acheson Colloids Company, Port Huron, Mich., is a suitable mold release material. The layer of mold release material applied is not thick enough to create a significant gap between the supportive region and the substrate.

The combustor liner panel 12 of the present invention is formed by projecting the supportive region 34 of each of an array of refractory ceramic tiles 30 through a layer of a fugitive material, typically graphite foil (not shown), as e.g., Grafoil TM, available from Union Carbide Corporation, and into plies of woven fibers 50 which are impregnated with the ceramic matrix material, and consolidating the woven fiber layers and glass matrix material to form a fiber reinforced glass ceramic matrix composite substrate 24 around the supportive regions of the tiles. The supportive regions of the refractory ceramic tiles may be embedded in the fiber layer either before or after the fiber layer is impregnated with the glass ceramic matrix material.

For example, as in the preferred embodiment shown in the Figures, the substrate 24 may be formed by laying up plies of woven fibers 50 that have been impregnated with a powdered glass ceramic matrix composition as discussed in commonly assigned U.S. Pat. No. 4,341,826, the disclosure of which is incorporated herein by reference. The supportive region 34 of each tile 30 is preferably forced through the holes in the layer of the fugitive material and between the fibers of each ply of the woven fiber reinforcement. Alternatively, holes to accommodate the supportive regions of the tiles may be produced in the woven fiber plies before layup.

The laid up plies are then consolidated by, for example, hot pressing, vacuum hot pressing or hot isostatic pressing. For example, LAS impregnated plies may be consolidated by vacuum hot pressing at temperatures between about 1200° C. and 1500° C. at pressures between 250 psi and 5000 psi for a time period between about two minutes and about one hour, wherein a shorter time period would typically be associated with a higher temperature and pressure. During consolidation, the fugitive layer, which is initially about 0.010" thick, is compressed to a thickness of about 0.005–0.007".

After the laid up plies have been consolidated, the assembly is then fired again, this time in an air atmosphere. This removes the fugitive layer graphite foil, and leaves the uniform space 31 between the tiles and the substrate which reduces the contacted surface area between the tile and substrate, thereby reducing heat conduction from the tiles to the substrate. This allows the tiles to function as a substantially better insulator for the substrate and permits the higher operating temperatures required in advanced engines. Alternatively, the fiber layer may be built up around the supportive region 34 of each tile 30 from unimpregnated fiber. The fiber layer may then be impregnated, and the impregnated fiber layer may be consolidated by the matrix transfer process described in commonly owned U.S. Pat. No. 4,428,763, the disclosure of which is incorporated herein by reference. The article so produced may be further consolidated by vacuum hot pressing as discussed above.

If a glass-ceramic matrix material is used and a glass-ceramic matrix is desired, the article may then be consolidated by heating to a temperature between about 800° C. and about 1600° C. for a time period of between about two hours and about 48 hours, preferably in an inert atmosphere, to partially crystallize the matrix.

It should be noted that, in the design of prior art combustor liners, it is extremely important to consider the potential effects of differential thermal expansion of the elements of the liner panel to avoid damage to the ceramic tiles as the combustor heats up and cools down. Tailoring of the coefficient of thermal expansion (CTE) of the composite substrate is achieved by judicious choices of fiber and matrix materials and of the proportion in which they are combined. The optimum CTE must typically be traded off against other properties in fabricating the composite substrate. In the present invention, spraying of a graphite layer on the supportive region 34 prevents adherence of the tile to the substrate, thus greatly diminishing the criticality of CTE relationships.

A preferred technique for precisely positioning the area of tiles comprises bonding the array to a positioning device, which can be a part of the mold assembly. A faceted graphite block has been determined to work effectively for this purpose. Each tile of the array is selectively positioned and secured to the graphite block by an adhesive. A viscous graphite adhesive, UCAR C-34, available from Union Carbide Corporation, Carson Products Division is preferred because of its low curing temperature and high temperature strength. The graphite adhesive is cured by heating, for example, at 130° C. for 16 hours. After the adhesive is cured, the tiles are embedded in the glass ceramic matrix impregnated fiber layer and the substrate is consolidated as discussed above. The graphite adhesive has sufficient temperature resistance to withstand the consolidation process, provided the process is carried out in an inert atmosphere. After consolidation the graphite adhesive is removed by heating in air, for example at 595° C. for 1.5 hours.

EXAMPLE

A ceramic tile-lined composite combustor liner panel was fabricated by inserting silicon nitride tiles manufactured by Kyocera Corporation, Kyoto, Japan, through a single layer of Grafoil TM foil of 0.010" thickness, and into four layers of Nicalon TM Plain Weave Cloth which was preimpregnated with an LAS glass ceramic matrix. The tile supportive regions were sprayed with a very thin layer of Aerodag G TM and fired at about 100° C. for about four hours and at about 125° C. for 16 hours prior to assembly with the Grafoil TM and Nicalon TM. The assembled panel was compacted under a pressure of about 700 psi at 1350° C. for about 30 minutes in vacuum, followed by heating in air for 60 minutes at 1000° C. The resulting panel had a space between the tiles and the substrate which was 0.005–0.008" wide, and the supportive regions of the tiles remained unbonded to the substrate.

The panel was tested in a gas turbine engine combustor rig for eight hours of steady state and cyclic testing. Examination of the panel after testing revealed that no tiles had fractured at the supportive-protective region interface, as had happened in previous testing without use of the Aerodag G TM. The design temperature of the tiles used in the combustor is about 1370° C., which is 150°–320° C. hotter than the metal designs currently used. The incorporation of the space between the tiles and the substrate, and the use of the Grafoil TM to prevent bonding of the tiles to the substrate, permitted successful operation of the combustor liner at significantly higher temperatures than for a state-of-the-art metal combustor liner, and required approximately 30% less cooling air.

The combustor liner of the present invention allows a higher operating temperature than conventional combustors, with combustor wall temperatures approaching local gas temperature. The higher temperature resistance of the ceramic tiles and the space incorporated between the tiles and the substrate allows a reduction in the amount of cooling air required, thus increasing the performance of the engine.

Although this invention has been shown and described with respect to detailed embodiments thereof, it will be understood by those skilled in the art that various changes in form and detail thereof may be made without departing from the spirit and scope of the claimed invention.

We claim:

1. A combustor liner panel for a gas turbine engine combustor comprising a fiber reinforced glass ceramic matrix composite substrate, said substrate having an inner surface and an outer surface, an array of refractory ceramic tiles substantially covering the inner surface of the substrate to thermally insulate the substrate, said tiles each having a protective region having an inner surface and an outer surface, and a supportive region extending from the protective region toward the outer surface of the substrate and embedded in the substrate to lock the tile immovably to the substrate, so that the supportive region is engaged with and restrained by said substrate around the entire periphery of said supportive region each tile covering a section of the inner surface of the substrate, said tiles each being positioned so as to provide a gap between the outer surface of the protection region of the tile and the inner surface of the substrate.

2. The combustor liner panel of claim 1 wherein the refractory ceramic tiles comprise silicon carbide or silicon nitride.

3. The combustor liner panel of claim 1 wherein the glass ceramic matrix comprises lithium aluminosilicate.

4. The combustor liner panel of claim 1 wherein the fiber reinforcement comprises silicon carbide fibers or silicon nitride fibers.

5. A combustor liner for a gas turbine engine combustor, comprising a metallic shell having an inner surface, and an array of combustor liner panels attached to the metallic shell and disposed in an axially overlapping arrangement to provide line-of-sight coverage for the inner surface of the shell, said combustor liner panels each comprising a fiber reinforced glass ceramic matrix composite substrate, said substrate having an inner surface and an outer surface, and an array of refractory ceramic tiles substantially covering the inner surface of the substrate to thermally insulate the substrate, said tiles each having a protective region having an inner surface and an outer surface, and a supportive region extending from the protective region toward the outer surface of the substrate and embedded in the substrate to lock the tile immovably to the substrate, so that the supportive region is engaged with and restrained by said substrate around the entire periphery of said supportive region each tile covering a section of the inner surface of the substrate, said tiles each being positioned so as to provide a space between the outer surface of the protective region of the tile and the inner surface of the substrate.

6. The combustor liner panel of claim 5 wherein the refractory ceramic tiles comprise silicon carbide or silicon nitride.

7. The combustor liner panel of claim 5 wherein the glass ceramic matrix comprises lithium aluminosilicate.

8. The combustor liner panel of claim 5 wherein the fiber reinforcement comprises silicon carbide fibers or silicon nitride fibers.

* * * * *